US008907233B2

(12) United States Patent
Chu

(10) Patent No.: US 8,907,233 B2
(45) Date of Patent: Dec. 9, 2014

(54) ELECTRICAL SWITCH

(75) Inventor: Wilson Wai Cheong Chu, Hong Kong (CN)

(73) Assignee: Defond Components Limited, Hong Kong, SAR (CN)

( * ) Notice: Subject to any disclaimer, the term of this patent is extended or adjusted under 35 U.S.C. 154(b) by 143 days.

(21) Appl. No.: 13/284,477

(22) Filed: Oct. 28, 2011

(65) Prior Publication Data

US 2013/0105293 A1 May 2, 2013

(51) Int. Cl.

| | |
|---|---|
| ***H01H 13/74*** | (2006.01) |
| ***H01H 13/76*** | (2006.01) |
| ***H01H 3/42*** | (2006.01) |
| ***H01H 15/10*** | (2006.01) |

(52) U.S. Cl.

CPC ..... *H01H 13/76* (2013.01); *H01H 3/42* (2013.01); *H01H 15/102* (2013.01)

USPC ..... 200/5 E; 200/5 B

(58) Field of Classification Search

USPC ..... 200/536, 5 E; 439/507, 710, 511

See application file for complete search history.

(56) References Cited

U.S. PATENT DOCUMENTS

| | | | | |
|---|---|---|---|---|
| 6,431,895 | B1 * | 8/2002 | Hung | 439/241 |
| 8,466,381 | B2 * | 6/2013 | Galpchian | 200/5 E |
| 2008/0023314 | A1 * | 1/2008 | Tseng | 200/5 B |
| 2013/0037396 | A1 * | 2/2013 | Yu | 200/293 |

* cited by examiner

*Primary Examiner* — Renee Luebke
*Assistant Examiner* — Ahmed Saeed
(74) *Attorney, Agent, or Firm* — Leydig, Voit & Mayer, Ltd.

(57) ABSTRACT

An electrical switch has a switch body with upper and lower body parts; actuators; individual switch terminals, each switch terminal having a contact part in the switch body; a common switch terminal having a contact portion in the switch body; and cam sliders extending side-by-side between the actuators and the contact parts of the individual switch terminals, sliding to move the contact parts into and out of contact with the common switch terminal. The contact portion of the common switch terminal extends across the contact parts of the individual switch terminals. The contact portion is sandwiched by the upper and lower body parts. At least two individual switch terminals are located along one side of the switch body, each individual switch terminal having an aperture accessible on the same side of the switch body, in which two ends of a conductor are insertable to short-circuit the two individual switch terminals.

31 Claims, 8 Drawing Sheets

ELECTRICAL SWITCH

The present invention relates to an electrical switch.

BACKGROUND OF THE INVENTION

Keyboard switches are a type of electrical switches widely used in electric food processors or blenders to control power on/off and speed and to perform momentary features e.g. a quick chop and/or mix after the appliance has been switched off. Usually the speed control is achieved by connecting different set of motor windings to the power source. The use of keyboard switches is cost effective way for speed control by mechanical means. As to construction, keyboard switches have a body with a single row of press buttons atop and one or two rows of switch terminals underneath and includes a switching mechanism provided by a set of cam slider blades for making and breaking electrical connection between internal parts of the switch terminals.

In an effort to combat the rise in copper and material costs, it is necessary to simplify the construction of keyboard switches but to maintain the switch performance and current rating.

The invention seeks to provide a new or otherwise improved electrical switch of this kind, whose construction is simpler and production cost lower.

SUMMARY OF THE INVENTION

According to a first aspect of the invention, there is provided an electrical switch comprising a switch body having at least two, upper and lower body parts assembled together, a plurality of actuators in the upper body part, a plurality of individual switch terminals located on the lower body part, each individual switch terminal having or being associated with a respective contact part in the switch body, at least one common switch terminal located on the lower body part, the common switch terminal comprising a contact portion in the switch body, and a plurality of cam sliders extending side-by-side in the switch body between the actuators and the contact parts of the individual switch terminals for sliding by the actuators to cause movement of the contact parts of at least some of the individual switch terminals into and out of contact with the contact portion of the common switch terminal to perform switching operation. The contact portion of the common switch terminal extends across the contact parts of said at least some of the individual switch terminals for contact thereby, and the contact portion is sandwiched by and between the upper and lower body parts.

Preferably, the upper body part has a shoulder closer to the lower body part, with an underside of which shoulder the upper body part engages the contact portion of the common switch terminal.

Preferably, the contact portion of the common switch terminal lies on an imaginary plane substantially parallel to the interface between the upper and lower body parts.

Preferably, the contact portion of the common switch terminal is flat plain rectangular.

Preferably, the contact parts of said at least some of the individual switch terminals lie close to the lower body part, and the contact portion of the common switch terminal is spaced apart from and above the contact parts by a plurality of spacers on the lower body part.

Preferably, the common switch terminal includes an end portion which extends through the lower body part and is exposed outside the switch body for connection by an electric cable.

More preferably, the end portion of the common switch terminal is integrally connected to the contact portion and is folded through an angle of substantially 90° relative to the contact portion.

More preferably, the common switch terminal includes a second end portion opposite to the first-mentioned end portion, the second end portion being hook-shaped and anchored with the lower body part for holding an adjacent end of the contact portion in position.

It is preferred that the common switch terminal has an inverted rectangular U-shape.

In a preferred embodiment, the lower body part has a first row of regular slots, and the common switch terminal has two opposite ends and is located on the lower body part with its opposite ends inserted into two slots of the slots respectively, the common switch terminal being of a length equal to the distance by which the two slots are spaced apart from each other, one of the opposite ends of the common switch terminal extending through the lower body part and being exposed outside the switch body for connection by an electric cable.

More preferably, the slots are evenly spaced apart, and the length of the common switch terminal is a multiple of the separation between adjacent slots.

More preferably, the lower body part has a second row of regular slots substantially parallel to the first row of slots for locating the individual switch terminals, the slots of the second row being substantially symmetrically offset from the slots of the first row.

It is preferred that at least one of the individual switch terminals includes an end part which is integral with the contact part, and extends through the lower body part and is exposed outside the switch body for connection by an electric cable.

It is preferred that the upper and lower body parts are snap fitted together.

It is further preferred that the upper body part has a plurality of hooks snap fitted upon the lower body part at positions where the lower body part has recesses to accommodate the hooks respectively such that the hooks are substantially flush with an outer surface of the switch body.

In a preferred embodiment, the electrical switch includes an electrical conductor having two ends, and at least two of the individual switch terminals are located along one side of the switch body, each having a part accessible on the same side of the switch body, with which the two ends of the conductor are engageable to come into electrical contact with the two individual switch terminals respectively, thereby short-circuiting the two individual switch terminals.

More preferably, the part of each of the two individual switch terminals comprises an aperture, into which the two ends of the conductor are insertable respectively to come into electrical contact with and thus short-circuit the two individual switch terminals.

Further more preferably, the part of each of the two individual switch terminals includes a self-gripping device about the aperture, the self-gripping device automatically gripping the respective end of the conductor upon insertion against withdrawal.

Yet further more preferably, each self-gripping device comprises at least one projection on one side of the aperture, the projection pointing at an angle inwards.

Yet further more preferably, each self-gripping device comprises a pair of said projections, each in the form of a tab, on opposite sides of the aperture, the tabs pointing in opposite directions generally at each other and at an angle inwards.

It is preferred that the aperture of each of the two individual switch terminals is located within the thickness of the lower body part.

It is further preferred that the lower body part includes a cavity aligned with the aperture, through which aperture the corresponding end of the conductor is inserted into the cavity and fitted in the cavity.

In a preferred construction, the conductor has a middle section and a pair of opposite ends at right angles thereto pointing in generally the same direction.

According to a second aspect of the invention, there is provided an electrical switch comprising a switch body, a plurality of actuators in the switch body, a plurality of individual switch terminals, each having or being associated with a respective contact part in the switch body, at least one common switch terminal comprising a contact portion in the switch body, and a plurality of cam sliders extending side-by-side in the switch body between the actuators and the contact parts of the individual switch terminals for sliding by the actuators to cause movement of the contact parts of at least some of the individual switch terminals into and out of contact with the contact portion of the common switch terminal to perform switching operation. The electrical switch includes an electrical conductor having two ends. At least two of the individual switch terminals are located along one side of the switch body, each having a part accessible on the same side of the switch body, with which the two ends of the conductor are engageable to come into electrical contact with the two individual switch terminals respectively, thereby short-circuiting the two individual switch terminals.

Preferably, the part of each of the two individual switch terminals comprises an aperture, into which the two ends of the conductor are insertable respectively to come into electrical contact with and thus short-circuit the two individual switch terminals.

More preferably, the part of each of the two individual switch terminals includes a self-gripping device about the aperture, the self-gripping device automatically gripping the respective end of the conductor upon insertion against withdrawal.

Further more preferably, each self-gripping device comprises at least one projection on one side of the aperture, the projection pointing at an angle inwards.

Yet further more preferably, each self-gripping device comprises a pair of said projections, each in the form of a tab, on opposite sides of the aperture, the tabs pointing in opposite directions generally at each other and at an angle inwards.

It is preferred that the aperture of each of the two individual switch terminals is located within the thickness of a lower body part of the switch body.

It is further preferred that the lower body part includes a cavity aligned with the aperture, through which aperture the corresponding end of the conductor is inserted into the cavity and fitted in the cavity.

In a preferred construction, the conductor has a middle section and a pair of opposite ends at right angles thereto pointing in generally the same direction.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
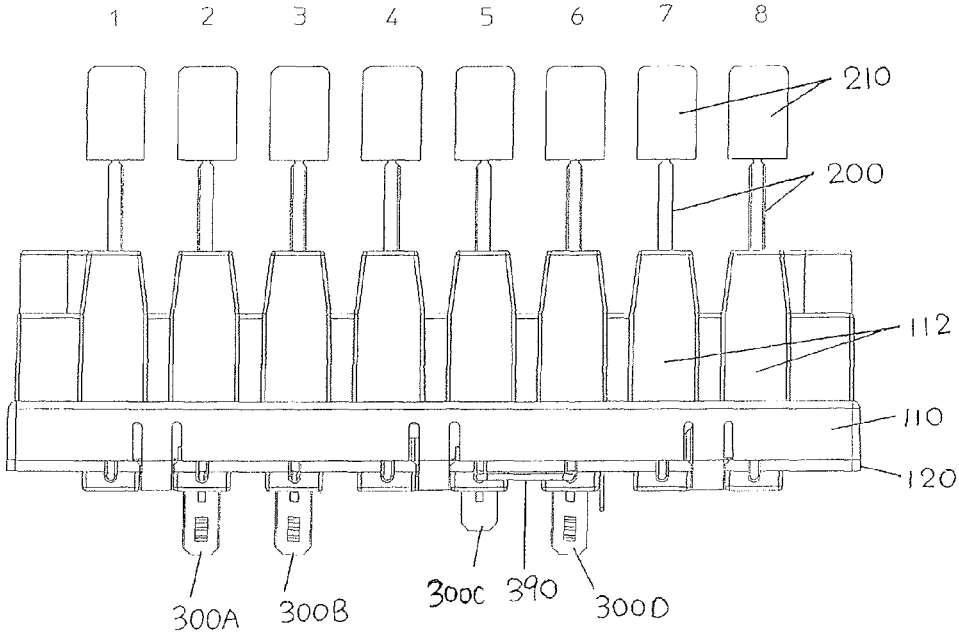
FIG. 1 is a side view of an embodiment of an electrical switch in accordance with the invention.
Figure 2:
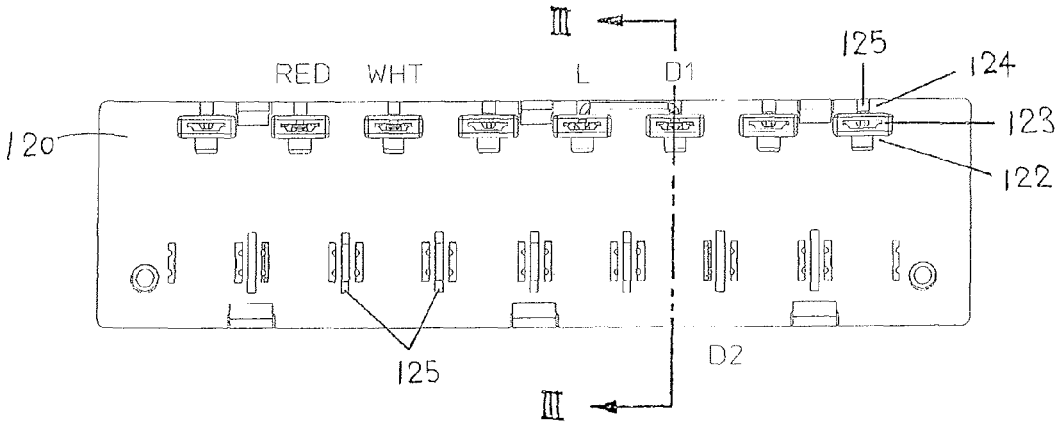
FIG. 2 is a bottom plan view of the electrical switch of FIG. 1.
Figure 3:
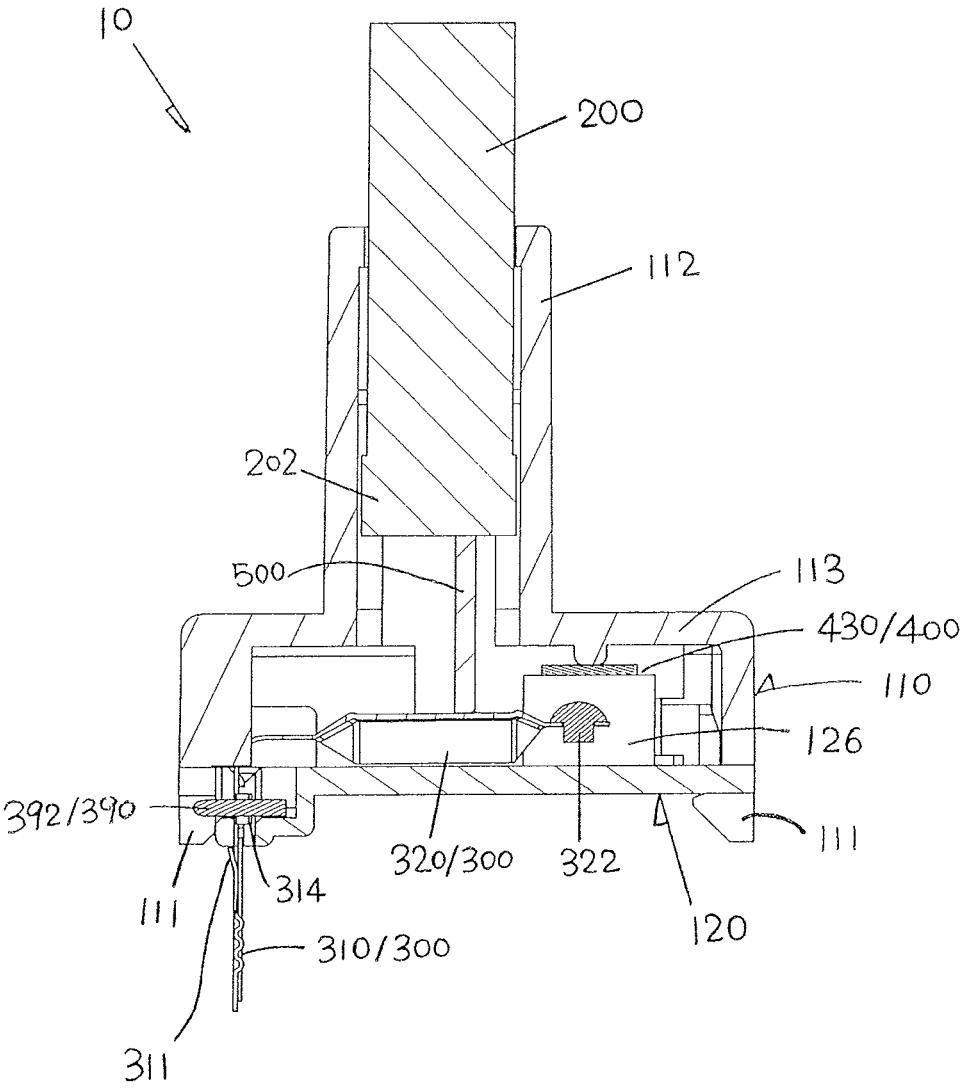
FIG. 3 is a cross-sectional end view of the electrical switch of FIG. 2, on an enlarged scale and taken along line III-III.

Referring to the drawings, there is shown an electrical switch 10 embodying the invention, which is generally known as a keyboard switch for controlling the operation of an electrical appliance such as a food processor or the like that is capable of operation in different modes such as at different speeds (in one direction of the other) as well as momentary operation upon simple user's action such as pressing of a button.

The keyboard switch 10 has an elongate switch body 100, a row of eight evenly spaced actuators 200 (i.e. 200A to 200H from left to right in FIG. 4) each being fitted with a button cap 210 on the upper side of the body 100, and five switch terminals 300 (i.e. 300A to 300D) and 400 on the lower side. Included is a stack of four cam slider blades 500 (i.e. 500A to 500D from front to back in FIG. 4) which extend side-by-side in the switch body 100 between the actuators 200 and contact parts of the switch terminals 300 for sliding by the actuators 200 to move the contact parts of at least some of the switch terminals 300 into and out of contact with a contact portion of the other switch terminal 400, thereby performing switching operation.

The switch body 100 has at least two, upper and lower body parts, namely an oblong upper switch case 110 and a rectangular lower terminal board 120 closing the switch case 110 from below. The switch case 110 is molded to have a row of eight regular chimney-like chambers 112 centrally along its length, and a pair of longitudinally-extending shoulders 113 on opposite sides of the chambers 112. Each chamber 112 locates a respective actuator 200 partially therein for individual limited vertical sliding movement. Projecting out of the chambers 112, upper ends 201 of the actuators 200 are covered with the button caps 210, together forming a row of eight press buttons or a keyboard.

The switch case 110 has six hooks 111 depending integrally from its bottom rim, which snap fit upon and around the periphery of the terminal board 120 such that the board 120 is tightly assembled with the switch case 110. At the position of each hook 111, the terminal board 120 is formed with a recess in the form of a cutout 121 to accommodate the footprint of the hook 111 such that the hook 111 is substantially flush with the outer surface of the switch case 110.

The terminal board 120 locates the switch terminals 300 and 400 by means of slots in two parallel rows of different designs on opposite longer sides of the board 120. There are eight regular slots 122 in the first row evenly spaced apart along one longer side of the terminal board 120, each being a cruciform slot 122 in the shape of a cross formed by intersection of two narrow slots, namely a longitudinal slot 123 extending along the length of the board 120 and a transverse slot 124 extending along the width. The transverse slot 124 has an open end 125 at where it meets the adjacent edge of the board 120. The open end 125 acts as an entrance through which a thin rod or pin may be inserted lengthwise into the slot 124.

As to the other row, there are seven regular slots 125 evenly spaced apart along the opposite longer side of the terminal board 120, each extending parallel to the board's shorter sides. Each slot 125 is flanked by a pair of rectangular spacers 126 such that the slot 125 is extended upwardly from the board 120 through a narrow gap between the two spacers 126.

The slots 122/125 of each row are positioned at regular intervals along the corresponding longer side of the terminal board 120. As between the two rows, the slots 122 and 125 are substantially symmetrically offset from each other across the width of the board 120.

One switch terminal 400 is a common terminal, with which one or more of the other four switch terminals 300 may be moved into or out of contact, according to a predetermined switch circuit design or switching scheme, together forming four normally-open switches. The four switch terminals 300 are herein referred to as individual terminals.

Four of the cruciform slots 122 are for separately locating the individual terminals 300, and two of the flat slots 125 serve to locate the common terminal 400, whereby the switch terminals 300 and 400 are all supported by or on the terminal board 120. In general not all the slots 122/125 may be in use, depending upon the number of switch terminals 300 and 400 employed or in general the switch circuit design.

The common terminal 400 is in the form of or made from an elongate copper strip in three straight sections, namely a main section 430 acting as a contact portion and two end sections 410 and 420 at opposite ends of the main section 430. Each of the end sections 410 and 420 is integrally connected to the main section 430 and is folded through an angle of substantially 90° relative to the main section 430 and extend at right angles thereto. The three sections 410 to 430 together have an inverted rectangular U-shape, with the main section 430 being the longest by far and the first end section 410 considerably longer than the second end section 420. The second end section 420 is hook-shaped or a right-angled hook.

Figure 4:
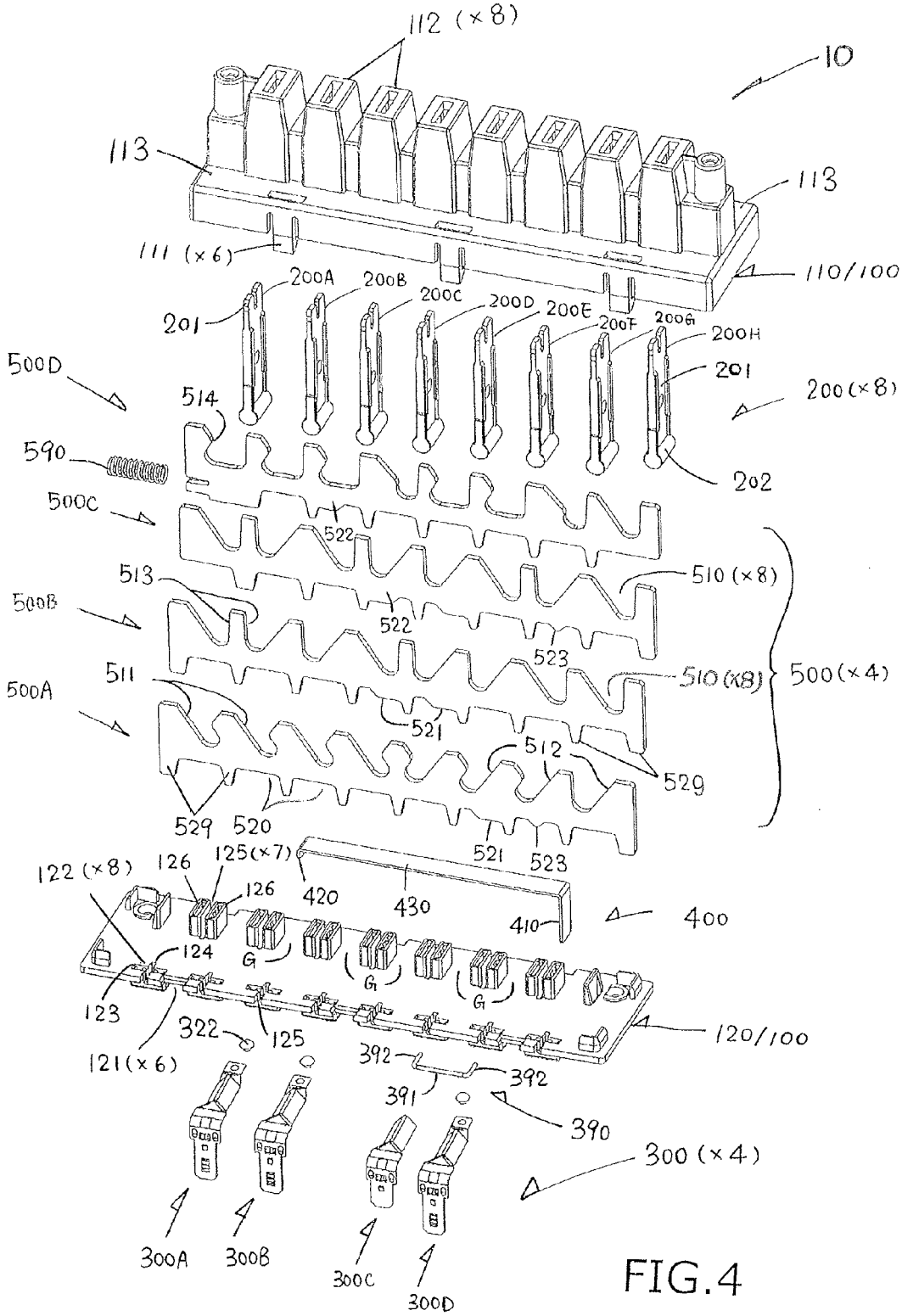
FIG. 4 is an exploded perspective view of the electrical switch of FIG. 1.
Figure 5:
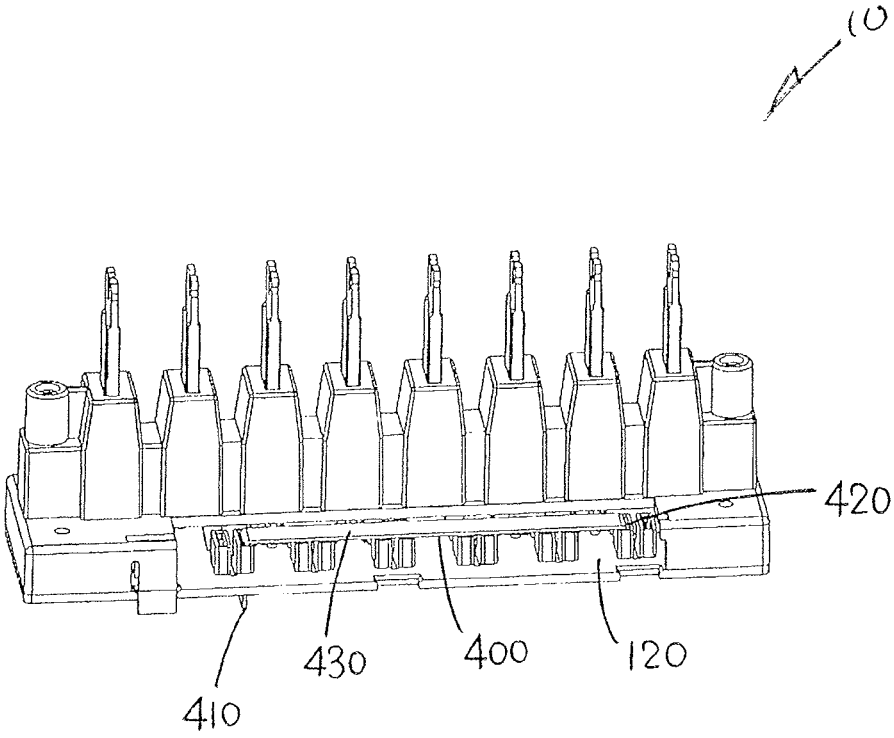
FIG. 5 is a perspective view of the electrical switch of FIG. 1, partially cut open to reveal a common switch terminal on one side of the switch.
Figure 6:
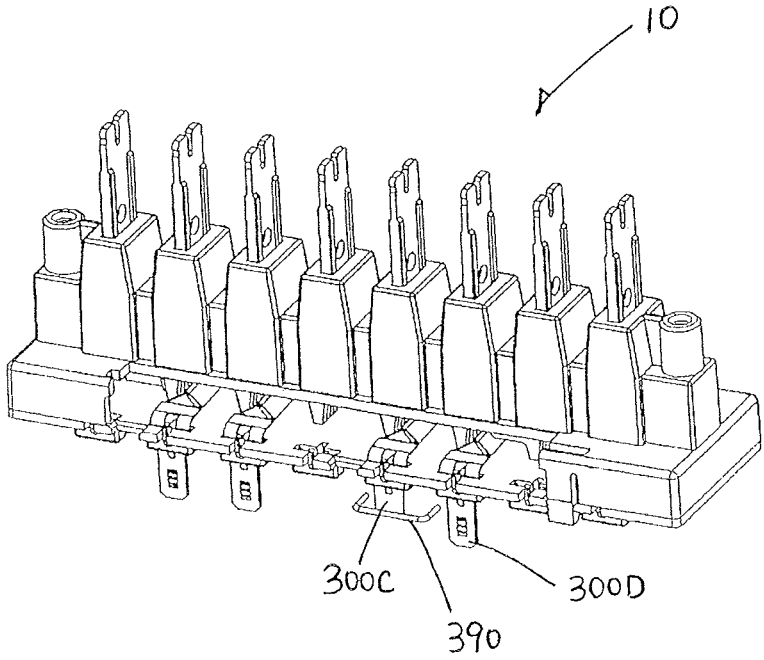
FIG. 6 is another perspective view of the electrical switch of FIG. 1, partially cut open to reveal individual switch terminals on the opposite side of the switch.
Figure 7A:
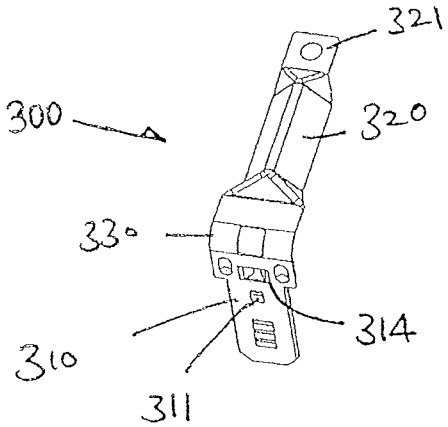
FIGS. 7A and 7B are two perspective views, taken in opposite directions, of an individual switch terminal of FIG. 6.
Figure 7B:
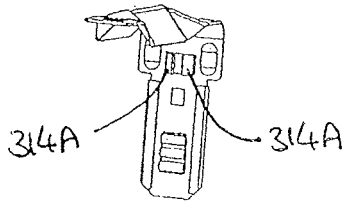
Figure 8:
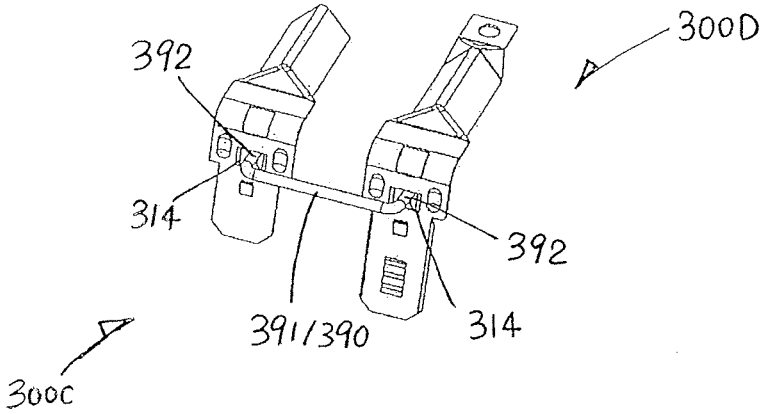
FIG. 8 is a perspective view of two individual switch terminals of FIGS. 7A and 7B, which are short-circuited by a jumper conductor.
Figure 9:
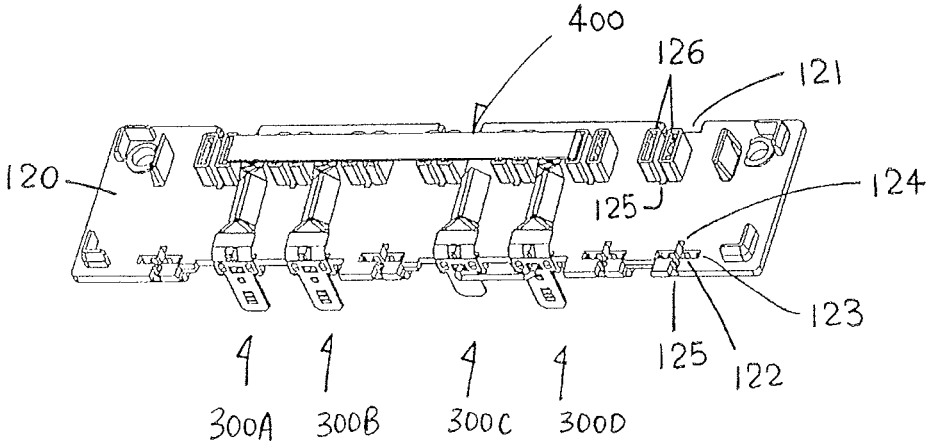
FIG. 9 is a perspective view of a lower part of the electrical switch, showing the common switch terminal and individual switch terminals arranged on opposite sides of the switch.

The main section 430 bridges from the $2^{nd}$ to $7^{th}$ slot 125 as viewed from left to right in FIG. 4, spanning across six slots 125 inclusive and bearing on the relevant spacers 126. The longer end section 410 is inserted, preferably as a tight fit, downwardly into the gap between the relevant spacers 126 and then through the $7^{th}$ slot 125, with the free end of this section 410 projecting from the bottom side of the terminal board 120 for terminal connection i.e. connection by an electric cable. The shorter end section 420 is inserted, preferably as a tight fit, into the gap between the spacers 126 of the $2^{nd}$ slot 125, being anchored with the terminal board 120 in that gap for holding the adjacent end of the main section 430 in position.

Upon being assembled with the terminal board 120, the switch case 110 bears from above, with a longitudinal rib 114 on the underside of its shoulder 113 on the relevant side, against the main section 430 to thereby hold or fix the common terminal 400 in place. The common terminal 400 is sandwiched by and between the upper and lower body parts 110 and 120. As the shoulders 113 are parts of the switch case 110 are closer to the terminal board 120, one of them is used to engage and sandwich the common terminal 400. The main section 430, that being flat plain rectangular, is particularly suitable for being held in position through a sandwiched arrangement, in which the main section 430 lies on an imaginary plane substantially parallel to the interface between the switch case 110 and terminal board 120, or in short horizontally.

While extending across the $2^{nd}$ and $7^{th}$ slots 125, the main section 430 bridges over five relatively wide gaps G between the spacers 126 of adjacent slots 125. In this regard, the common terminal 400 (or its main section 430) is of a length equal to the distance by which the $2^{nd}$ and $7^{th}$ slots 125 are spaced apart from each other.

As the slots 125 are evenly spaced apart, the length of the common to/urinal 400 is an integral multiple of the (even) separation between adjacent slots 125. This permits the use of a common terminal 400 at more than one position along the row of slots 125, as its length fits more than one pair of slots 125 separated by the same distance, such as the pair of $1^{st}$ and $6^{th}$ slots 125 in addition to the aforesaid pair of $2^{nd}$ and $7^{th}$ slots 125. Thus, the number of usable lengths of the common terminal 400 is limited, hence a substantial saving in inventory.

Each of these gaps G is in general aligned, across the width of the terminal board 120, with a respective cruciform slot 122 which locates an individual terminal 300 or is left vacant if no individual terminal 300 is intended at that position.

Each individual terminal 300 is made from an elongate copper strip, having a vertical limb 310 to which an electric cable may be connected and includes a transverse limb 320 acting as a contact part for contact making or breaking with the main section 430 of the common terminal 400. The vertical and transverse limbs 310 and 320 are integrally formed with each other, and joined end-to-end about a smoothly curved bend 330 through an angle slightly greater than 90°.

Each individual terminal 300 is located on the terminal board 120 by having its vertical limb 310 inserted downwardly through the longitudinal slot 123 of a respective cruciform slot 122, with the transverse limb 320 pointing inwards along the width of the terminal board 120, lying close to the board 120. The vertical limb 310 has a small rectangular tab 311 which is partially cut out on its upper and left and right sides and is bent at a small angle off the vertical limb 310 to point upwards. The tab 311 is a one-way latch engageable upon the underside of the terminal board 120 against withdrawal of the vertical limb 310 automatically upon the same being fully inserted through the slot 123.

The vertical limb 310 includes a small aperture 314 above the tab 311, which is aligned with the open end 125 of the transverse slot 124 of the cruciform slot 122 after the vertical limb 310 has been fully inserted through the slot 123 and latched in place. The aperture 314 is situated at the junction between the longitudinal and transverse slots 123 and 124, right behind the open end 125 of the transverse slot 124. All the apertures 314 are accessible on the same side of the switch body 100.

Opposite left and right sides of the aperture 314 are each cut with a small rectangular tab 314A. The two tabs 314A are formed in a similar way as the tab 311 below them, but they point in opposite directions generally at each other and at an angle inwards. Together the tabs 314A constitute a pair of self-gripping jaws or device which automatically grips upon a thin rod or pin inserted through the aperture 314, and into the transverse slot 124 via its open end 125, against withdrawal.

It is noted that one of such tabs 314A alone, on either or any side of the aperture 314 and pointing at angle inwards, is capable of self-gripping an end of the rod or pin inserted into the aperture 314, though a pair provides a relatively firmer and balanced grip. The use of three or more of such tabs 314A or equivalent projections generally stated, e.g. triangular teeth or spikes, is also possible.

In practice, the aforesaid thin rod or pin is a generally rectangular C-shaped jumper 390 of an electrically conducting material such as copper, i.e. an electrical conductor, which is formed by bending a copper rod or pin into that shape resembling a staple pin, having a middle section 391 and a pair of relatively shorter ends 392 at opposite ends of and at right angles to the middle section 391, pointing in generally the same direction. The middle section 391 has a length, as measured across the opposite ends 392, equal to the separation between two adjacent individual terminals 300 located on the terminal board 120.

In the described embodiment, the jumper 390 is used between the $3^{rd}$ and $4^{th}$ individual terminals 300C and 300D by having its opposite ends 392 inserted into their self-gripping apertures 314 respectively via the open ends 125 of the corresponding transverse slots 124. Each jumper end 392 upon insertion pushes open the pair of tabs 314A of the aperture 314, which by reaction resiliently press upon opposite sides of the end 392 at a relatively larger angle inwards, effectively biting into the end 392 inwardly to prevent withdrawal of the end 392.

By being aligned with the transverse slot 124 and its open end 125 of the terminal board 120, each aperture 314 is located within the thickness of the terminal board 120. The transverse slot 124 which is a cavity and into which the jumper end 392 is inserted, as it passes through the aperture 314, is of a width substantially the same as the diameter of the jumper end 392 such that the jumper end 392 fits in the slot 124, preferably as tight or force fit for firmly holding the jumper end 392 in place.

As the individual terminals 300 are evenly spaced along the length of the keyboard switch 10, the jumper 390 may be used between any pair of adjacent individual terminals 300. A longer jumper, which is twice as long as the jumper 390, may be used to short-circuit individual terminals 300 separated by two terminal positions, e.g. the $2^{nd}$ and $3^{rd}$ individual terminals 300B and 300C.

It is noted that the jumper 390 may be made longer as is necessary to bridge across three or more individual terminals 300 or positions thereof, for example to short-circuit the $1^{st}$ and $3^{rd}$ individual terminals 300A and 300C.

Free end 321 of the transverse limb 320, which is fitted with a contact pad 322 (except for the individual terminal 300C), reaches into an aligned gap G between two closest spacers 126 on the opposite side for contact upwardly with the main section 430 of the common terminal 400.

The circuit between the common terminal 400 and each individual terminal 300A/300B/300D is normally-closed. The transverse limb 320 of the individual terminals 300 is inclined at a relatively small angle upwards such that at rest it bears resiliently against the main section 430 of the common terminal 400 from below, by virtue of its own resilience, providing an appropriate contact force.

The main section 430 is spaced apart from, and above, the free ends 321 or contact pads 322 of the transverse limbs 320 by the spacers 126 on the terminal board 120. There is sufficient room underneath for the transverse limbs 320 to pivot downwards, albeit to a limited extent, so as to break the contact with the main section 430.

Each transverse limb 320 is stamped to have an inverted flat V-shaped cross-section for mechanical strength, whose apex along the limb's length forms a round ridge upon which the cam slider blades 500 slidably ride and act. Each blade 500 may press a transverse limb 320 downwards against the latter's resilience, or let it pivot upwards under the action of its own resilience.

In general, the slider blades 500 have a row of eight relatively deep upper recesses 510 and a row of eight relatively shallow lower recesses 520 which are in vertical alignment with the upper recesses 510. The upper recesses 510 are generally aligned as between adjacent blades 500. Within each stack of aligned upper recesses 510, a corresponding actuator 200 acts by its lowermost end 202 upon opposite sides (especially inclined sides) of the recesses 510, through a cam action where appropriate. Each actuator end 202 is generally cylindrical about a horizontal axis back-to-front.

The opposite sides of the upper recesses 510 may be a 45° left-inclined side 511 for a blade 500 concerned to be slid lengthwise to the left by the relevant actuator 200, a 45° right-inclined side 512 for the blade 500 to be slid to the right, a flat vertical side 513 for no blade sliding, or a bulging left side 514 (in the case of the rearmost blade 500D only) for temporarily holding the relevant actuator 200 down.

The lower recesses 520 define seven to nine legs 529 between adjacent recesses 520 and/or at either leftmost or rightmost end of the blades 500, by which the blades 500 stand on the terminal board 120 and are slidable lengthwise of the board 120 in opposite left and right directions. The lower recesses 520 may be vacant or include, at their bottoms, a right step 521, a left step 522 or a central knob 523. The step 521/522 serves to press and hold down the transverse limb 320 of a relevant individual terminal 300, thereby breaking or opening the circuit of this individual terminal 300 with the common terminal 400. The central knob 523 serves to open such a circuit momentarily.

At the leftmost end of the rearmost blade 500D, a lower recess 520 is absent and a compression coil 590 acts to resiliently bias the blade 500D to the right. Each bulging left side 514 of this blade 500D temporarily holds the relevant actuator 200 down while the blade 500D is slid to the right by the spring 590.

Figure 10:
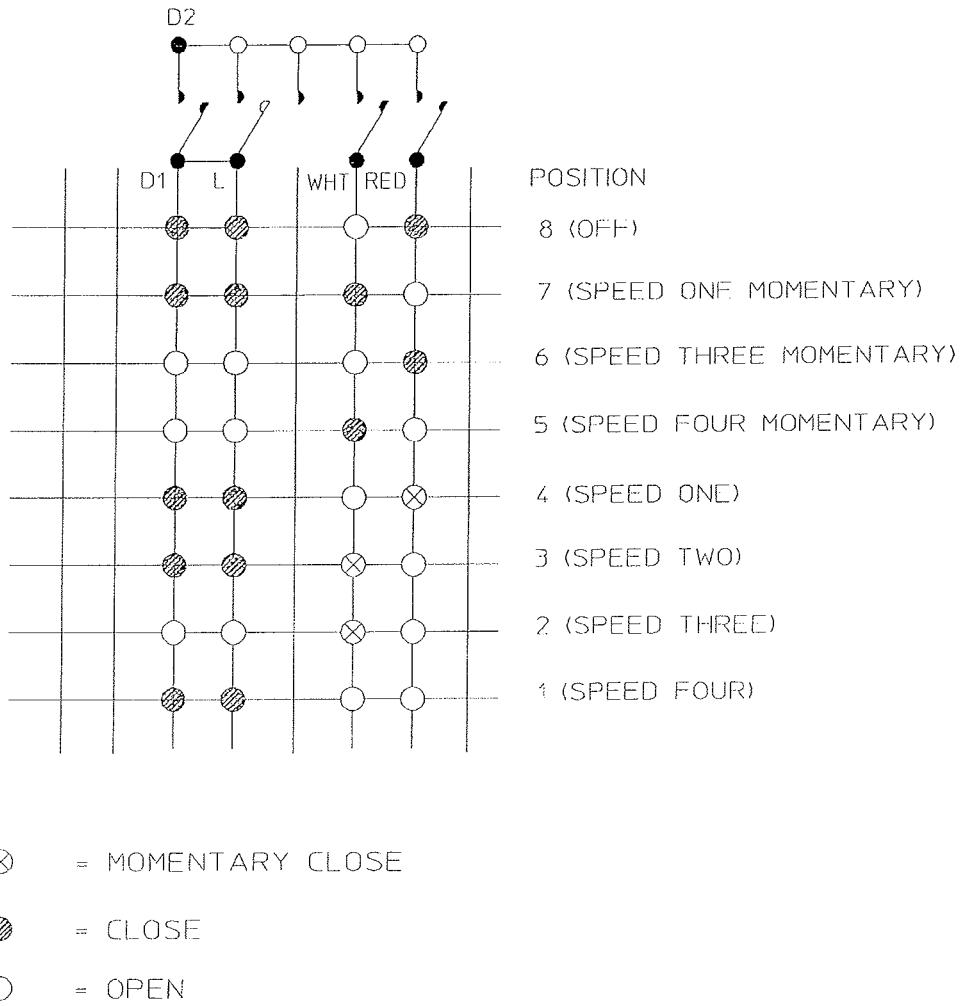
FIG. 10 is a schematic diagram showing a switch circuit design for the electrical switch.

A switch circuit design of the type suitable for the keyboard switch 10 is shown in FIG. 10, in which the actuators 200 may upon depression trigger the following operations:

| Depression | Operation |
|---|---|
| Actuator 200A | Off |
| Actuator 200B | Speed 1 Momentary |
| Actuator 200C | Speed 3 Momentary |
| Actuator 200D | Speed 4 Momentary |
| Actuator 200E | Speed 1 |
| Actuator 200F | Speed 2 |
| Actuator 200G | Speed 3 |
| Actuator 200H | Speed 4 |

The construction of the keyboard switch 10 as described above results in significant reduction of material usage and wastage in both the common as well as the individual switch terminals 400 and 300, and facilitates assembly during production.

The invention has been given by way of example only, and various other modifications of and/or alterations to the described embodiment may be made by persons skilled in the art without departing from the scope of the invention as specified in the appended claims.

What is claimed is:

1. An electrical switch comprising:

an electrical conductor having two ends, a switch body having upper and lower body parts assembled together, a plurality of actuators in the upper body part, a plurality of individual switch terminals located on the lower body part, each individual switch terminal having a respective contact part in the switch body, a common switch terminal located on the lower body part, the common switch terminal comprising a contact portion located in the switch body, and a plurality of cam sliders extending side-by-side in the switch body, between the actuators and the contact parts of the individual switch terminals, for sliding by the actuators to move the contact parts of at least some of the individual switch terminals into contact with and out of contact with the contact portion of the common switch terminal for switching operations, wherein the contact portion of the common switch terminal extends across the contact parts of the at least some of the individual switch terminals for contact by the contact portion of the common switch terminal, the contact portion is sandwiched by and between the upper and lower body parts, two of the individual switch terminals are located along a first edge of the switch body, each of the two individual switch terminals has a part accessible on at the first edge of the switch body, wherein the part of each of the two individual switch terminals comprises an aperture into which one of the ends of the conductor is inserted to make electrical contact with the respective individual switch terminal, and the part of each of the two individual switch terminals includes a self-gripping device about the aperture, the self-gripping device automatically gripping the respective end of the conductor upon insertion of the conductor into the aperture and resisting withdrawal of the respective end of the conductor from the aperture, and the ends of the conductor are respectively inserted into the two individual switch terminals and are in electrical contact with the two individual switch terminals, thereby short-circuiting the two individual switch terminals to each other.

2. The electrical switch as claimed in claim 1, wherein the upper body part has a shoulder close to the lower body part, and an underside of the shoulder of the upper body part engages the contact portion of the common switch terminal

3. The electrical switch as claimed in claim 1, wherein the contact portion of the common switch terminal lies on a plane substantially parallel to an interface between the upper and lower body parts.

4. The electrical switch as claimed in claim 1, wherein the contact portion of the common switch terminal is flat, planar, and rectangular.

5. The electrical switch as claimed in claim 1, including a plurality of spacers, wherein the contact parts of the at least some of the individual switch terminals lie close to the lower body part, and the contact portion of the common switch terminal is spaced apart from the contact parts by the plurality of spacers, which are located on the lower body part.

6. The electrical switch as claimed in claim 1, wherein the common switch terminal includes a first end portion which extends through the lower body part and is exposed outside the switch body for connection to an electric cable.

7. The electrical switch as claimed in claim 6, wherein the first end portion of the common switch terminal is integrally connected to the contact portion and is folded through an angle of substantially 90° relative to the contact portion.

8. The electrical switch as claimed in claim 6, wherein the common switch terminal includes a second end portion, opposite the first end portion, the second end portion being hook-shaped and anchored with the lower body part for holding an adjacent end of the contact portion in position.

9. The electrical switch as claimed in claim 1, wherein the common switch terminal has an inverted rectangular U-shape.

10. The electrical switch as claimed in claim 1, wherein the lower body part has a first row of slots, the common switch terminal has two opposite ends and is located on the lower body part with the opposite ends inserted into two respective slots, of the slots, the common switch terminal has a length equal to separation of at least two of the slots from each other, and one of the opposite ends of the common switch terminal extends through the lower body part and is exposed outside the switch body for connection to an electric cable.

11. The electrical switch as claimed in claim 10, wherein the slots are uniformly spaced apart, and the length of the common switch terminal is an integer multiple of the separation between adjacent slots.

12. The electrical switch as claimed in claim 10, wherein the lower body part has a second row of slots substantially parallel to the first row of slots for locating the individual switch terminals, and the slots of the second row are substantially symmetrically offset from the slots of the first row.

13. The electrical switch as claimed in claim 1, wherein at least one of the individual switch terminals includes an end part which is integral with the contact part, extends through the lower body part, and is exposed outside the switch body for connection to an electric cable.

14. The electrical switch as claimed in claim 1, wherein each self-gripping device comprises at least one projection on one side of the aperture, the projection pointing inwardly with respect to the switch body, at an angle.

15. The electrical switch as claimed in claim 14, wherein each self-gripping device comprises a pair of the projections, each projection being a tab, located on opposite sides of the aperture, the tabs pointing in opposite directions with respect to each other and at an inward angle relative to the switch body.

16. The electrical switch as claimed in claim 1, wherein the conductor has a middle section and a pair of end sections located at opposite ends of the middle section and bent at right angles to the middle section and generally pointing in a common direction.

17. An electrical switch comprising:

an electrical conductor having two ends, a switch body having upper and lower body parts assembled together, a plurality of actuators in the upper body part, a plurality of individual switch terminals located on the lower body part, each individual switch terminal having a respective contact part in the switch body, a common switch terminal located on the lower body part, the common switch terminal comprising a contact portion located in the switch body, and a plurality of cam sliders extending side-by-side in the switch body, between the actuators and the contact parts of the individual switch terminals, for sliding by the actuators to move the contact parts of at least some of the individual switch terminals into contact with and out of contact with the contact portion of the common switch terminal for switching operations, wherein the contact portion of the common switch terminal extends across the contact parts of the at least some of the individual switch terminals for contact by the contact portion of the common switch terminal, the contact portion is sandwiched by and between the upper and lower body parts, two of the individual switch terminals are located along a first edge of the switch body, each of the two individual switch terminals has a part accessible on at the first edge of the switch body, wherein the part of each of the two individual switch terminals comprises an aperture into which one of the ends of the conductor is inserted to make electrical contact with the respective individual switch terminal, and the lower body part has a thickness, and the apertures of each of the two individual switch terminals are located within the thickness of the lower body part, and the ends of the conductor are respectively inserted into the two individual switch terminals and are in electrical contact with the two individual switch terminals, thereby short-circuiting the two individual switch terminals to each other.

18. The electrical switch as claimed in claim 17, wherein the lower body part includes a cavity aligned with the aperture, and the end of a conductor passing through the aperture is in, and fitted, in the cavity.

19. The electrical switch as claimed in claim 17, wherein the conductor has a middle section and a pair of end sections located at opposite ends of the middle section and bent at right angles to the middle section and generally pointing in a common direction.

20. The electrical switch as claimed in claim 17, wherein the lower body part has a first row of slots, the common switch terminal has two opposite ends and is located on the lower body part with the opposite ends inserted into two respective slots, of the slots, the common switch terminal has a length equal to separation of at least two of the slots from each other, and one of the opposite ends of the common switch terminal extends through the lower body part and is exposed outside the switch body for connection to an electric cable.

21. The electrical switch as claimed in claim 20, wherein the slots are uniformly spaced apart, and the length of the common switch terminal is an integer multiple of the separation between adjacent slots.

22. An electrical switch comprising:

a switch body, a plurality of actuators in the switch body, a plurality of individual switch terminals, each individual switch terminal having a respective contact part located in the switch body, at least one common switch terminal comprising a contact portion located in the switch body, and a plurality of cam sliders extending side-by-side in the switch body, between the actuators and the contact parts of the individual switch terminals, for sliding by the actuators to move the contact parts of at least some of the individual switch terminals into contact with and out of contact with the contact portion of the common switch terminal for switching operations, wherein the electrical switch includes an electrical conductor having two ends, at least two of the individual switch terminals are located along a first edge of the switch body, wherein the part of each of the two individual switch terminals comprises an aperture into which one of the ends of the conductor is inserted to make electrical contact with the respective individual switch terminal, and the part of each of the two individual switch terminals includes a self-gripping device about the aperture, the self-gripping device automatically gripping the respective end of the conductor upon insertion of the respective end of the conductor into the aperture, and resisting withdrawal of the respective end of the conductor from the aperture, and each of the two individual switch terminals has a part accessible at the first edge of the switch body, and with which a respective end of the conductor is inserted and makes a respective electrical contact, thereby short-circuiting the two individual switch terminals to each other.

23. The electrical switch as claimed in claim 22, wherein each self-gripping device comprises at least one projection on one side of the aperture, the projection pointing inwardly with respect to the switch body, at an angle.

24. The electrical switch as claimed in claim 23, wherein each self-gripping device comprises a pair of the projections, each projection being a tab, located on opposite sides of the aperture, the tabs pointing in opposite directions with respect to each other and at an inward angle relative to the switch body.

25. The electrical switch as claimed in claim 22, wherein the conductor has a middle section and a pair of end sections located at opposite ends of the middle section and bent at right angles to the middle section and generally pointing in a common direction.

26. The electrical switch as claimed in claim 17, wherein the lower body part has a first row of slots, the common switch terminal has two opposite ends and is located on the lower body part with the opposite ends inserted into two respective slots, of the slots, the common switch terminal has a length equal to separation of at least two of the slots from each other, and one of the opposite ends of the common switch terminal extends through the lower body part and is exposed outside the switch body for connection to an electric cable.

27. The electrical switch as claimed in claim 26, wherein the slots are uniformly spaced apart, and the length of the common switch terminal is an integer multiple of the separation between adjacent slots.

28. An electrical switch comprising:

a switch body, a plurality of actuators in the switch body, a plurality of individual switch terminals, each individual switch terminal having a respective contact part located in the switch body, at least one common switch terminal comprising a contact portion located in the switch body, and a plurality of cam sliders extending side-by-side in the switch body, between the actuators and the contact parts of the individual switch terminals, for sliding by the actuators to move the contact parts of at least some of the individual switch terminals into contact with and out of contact with the contact portion of the common switch terminal for switching operations, wherein the electrical switch includes an electrical conductor having two ends, at least two of the individual switch terminals are located along a first edge of the switch body, wherein the part of each of the two individual switch terminals comprises an aperture in which one of the ends of the conductor is inserted to make electrical contact with the respective individual switch terminal, and the lower body part has a thickness, and the apertures of each of the two individual switch terminals are located within the thickness of the lower body part, and each of the two individual switch terminals has a part accessible at the first edge of the switch body, and with which a respective end of the conductor is inserted and makes a respective electrical contact, thereby short-circuiting the two individual switch terminals to each other.

29. The electrical switch as claimed in claim 28, wherein the lower body part includes a cavity aligned with the aperture, and the end of a conductor passing through the aperture is in, and fitted, in the cavity.

30. The electrical switch as claimed in claim 28, wherein the conductor has a middle section and a pair of end sections located at opposite ends of the middle section and bent at right angles to the middle section and generally pointing in a common direction.

31. The electrical switch as claimed in claim 28, wherein the lower body part has a first row of slots, the common switch terminal has two opposite ends and is located on the lower body part with the opposite ends inserted into two respective slots, of the slots, the common switch terminal has a length equal to separation of at least two of the slots from each other, and one of the opposite ends of the common switch terminal extends through the lower body part and is exposed outside the switch body for connection to an electric cable.

* * * * *